US009543070B2

(12) United States Patent
Lee

(10) Patent No.: US 9,543,070 B2
(45) Date of Patent: Jan. 10, 2017

(54) CHIP COIL COMPONENT

(71) Applicant: Samsung Electro-Mechanics CO., LTD., Suwon-Si, Gyeonggi-Do (KR)

(72) Inventor: Jung Chul Lee, Suwon-Si (KR)

(73) Assignee: SAMSUNG ELECTRO-MECHANICS CO., LTD., Suwon-si, Gyeonggi-do (KR)

( * ) Notice: Subject to any disclaimer, the term of this patent is extended or adjusted under 35 U.S.C. 154(b) by 77 days.

(21) Appl. No.: 14/489,030

(22) Filed: Sep. 17, 2014

(65) Prior Publication Data

US 2015/0371753 A1 Dec. 24, 2015

(30) Foreign Application Priority Data

Jun. 19, 2014 (KR) ..... 10-2014-0074860

(51) Int. Cl.
*H01F 5/00* (2006.01)
*H01F 27/29* (2006.01)
*H01F 17/00* (2006.01)

(52) U.S. Cl.
CPC ..... *H01F 27/292* (2013.01); *H01F 5/00* (2013.01); *H01F 17/0013* (2013.01); *H01F 2017/002* (2013.01)

(58) Field of Classification Search
CPC ..... H01F 5/00; H01F 27/00–27/30
USPC ..... 336/65, 83, 200, 206–208, 232
See application file for complete search history.

(56) References Cited

U.S. PATENT DOCUMENTS 6,107,907 A * 8/2000 Leigh ..... H01F 17/0006 336/200
6,223,422 B1 * 5/2001 Takeuchi ..... H01F 41/043 29/602.1
7,453,344 B2 * 11/2008 Maeda ..... H01F 17/0013 336/200
2010/0127812 A1 * 5/2010 Maeda ..... H01F 17/0013 336/200
2011/0037557 A1 * 2/2011 Konoue ..... H01F 17/0013 336/200
2013/0200980 A1 8/2013 Yokoyama et al.
2015/0287514 A1 * 10/2015 Lim ..... H01F 17/0013 336/65

(Continued)

FOREIGN PATENT DOCUMENTS

JP 2001-358016 A 12/2001
JP 2013-162101 A 8/2013
KR 10-2012-0055253 A 5/2012

*Primary Examiner* — Tuyen Nguyen
(74) *Attorney, Agent, or Firm* — McDermott Will & Emery LLP

(57) ABSTRACT

A chip coil component may include: a ceramic body including a plurality of first to fourth insulating layers, and an internal coil including a first internal pattern part having the plurality of first insulating layers on which first pattern portions are disposed and a second internal pattern part having the plurality of second insulating layers on which second pattern portions are disposed. The first pattern portions disposed on the plurality of first insulating layers are disposed to correspond to each other and are connected to each other by two first connection terminals each having one via electrode, and the second pattern portions disposed on the plurality of second insulating layers are disposed to correspond to each other and are connected to each other by two second connection terminals each having one via electrode.

12 Claims, 8 Drawing Sheets

(56) References Cited

U.S. PATENT DOCUMENTS

2015/0294779 A1* 10/2015 Lim ..... H01F 27/292
336/192

* cited by examiner

CHIP COIL COMPONENT

CROSS-REFERENCE TO RELATED APPLICATION

This application claims the benefit of Korean Patent Application No. 10-2014-0074860 filed on Jun. 19, 2014, with the Korean Intellectual Property Office, the disclosure of which is incorporated herein by reference.

BACKGROUND

The present disclosure relates to a chip coil component.

An inductor, a multilayer chip component, is a representative passive element forming an electronic circuit together with a resistor and a capacitor to remove noise or to be used as a component forming an LC resonance circuit.

Meanwhile, the use of multilayer inductors has recently increased. Such multilayer inductors have a structure in which a plurality of magnetic layers or dielectric layers on which internal coil pattern parts are formed are stacked and the internal coil pattern parts are connected to each other to form a coil structure, thereby achieving target levels of inductance, impedance, and the like.

When the number of coil turns of an internal coil in the multilayer inductor is increased to generate a high level of inductance, direct current (DC) resistance may be increased, thereby degrading a quality factor (Q characteristics).

Accordingly, in order to decrease the direct current (DC) resistance of such a multilayer inductor, a parallel structure, in which an interlayer connection between the internal coil pattern parts connected to external electrodes is performed in parallel and the internal coil patterns having the same shape are repeatedly formed in pairs, may be used.

However, in the case in which the parallel structure is used, an amount of interlayer via connections may inevitably be increased, and as a result, the inductance and the Q factor of a final product may be degraded.

RELATED ART DOCUMENT (Patent Document 1) Japanese Patent Laid-Open Publication No. 2001-358016

SUMMARY

An exemplary embodiment in the present disclosure may provide a chip coil component capable of improving inductance and a quality factor (Q value).

According to an exemplary embodiment in the present disclosure, a chip coil component may include: a ceramic body including a plurality of first to fourth insulating layers; and an internal coil including a first internal pattern part having the plurality of first insulating layers on which first pattern portions are disposed and a second internal pattern part having the plurality of second insulating layers on which second pattern portions are disposed, wherein the first pattern portions disposed on the plurality of first insulating layers are disposed to correspond to each other and are connected to each other by two first connection terminals each having one via electrode, and the second pattern portions disposed on the plurality of second insulating layers are disposed to correspond to each other and are connected to each other by two second connection terminals each having one via electrode.

According to an exemplary embodiment in the present disclosure, a chip coil component may include: a ceramic body including a plurality of insulating layers and having a bottom surface provided as a mounting surface; and a plurality of internal pattern parts disposed within the ceramic body and having N internal coil pattern portions connected thereto, where N is multiples of 2 equal to or greater than 4, wherein an n-th internal coil pattern portion and an n−1-th internal coil pattern portion based on an internal coil pattern portion closest to the bottom surface of the ceramic body among the N internal coil pattern portions are connected in parallel to each other, where n<=N, n=2a, and a is a natural number, and the n-th internal coil pattern portion and the n−1-th internal coil pattern portion are connected to each other by two connection terminals each having one via electrode.

According to an exemplary embodiment in the present disclosure, a chip coil component may include: a ceramic body including a plurality of first to fourth insulating layers and having a bottom surface provided as a mounting surface; and an internal coil including a first internal pattern part having the plurality of first insulating layers on which first pattern portions are disposed, and a second internal pattern part having the plurality of second insulating layers on which second pattern portions are disposed, wherein the first pattern portions disposed on the plurality of first insulating layers are disposed to correspond to each other and are connected to each other by two first connection terminals each having one via electrode, the second pattern portions disposed on the plurality of second insulating layers are disposed to correspond to each other and are connected to each other by two second connection terminals each having one via electrode, and the internal coil is disposed to be perpendicular with respect to the bottom surface of the ceramic body.

BRIEF DESCRIPTION OF THE DRAWINGS

The above and other aspects, features and advantages in the present disclosure will be more clearly understood from the following detailed description taken in conjunction with the accompanying drawings, in which.

DETAILED DESCRIPTION

Figure 1:
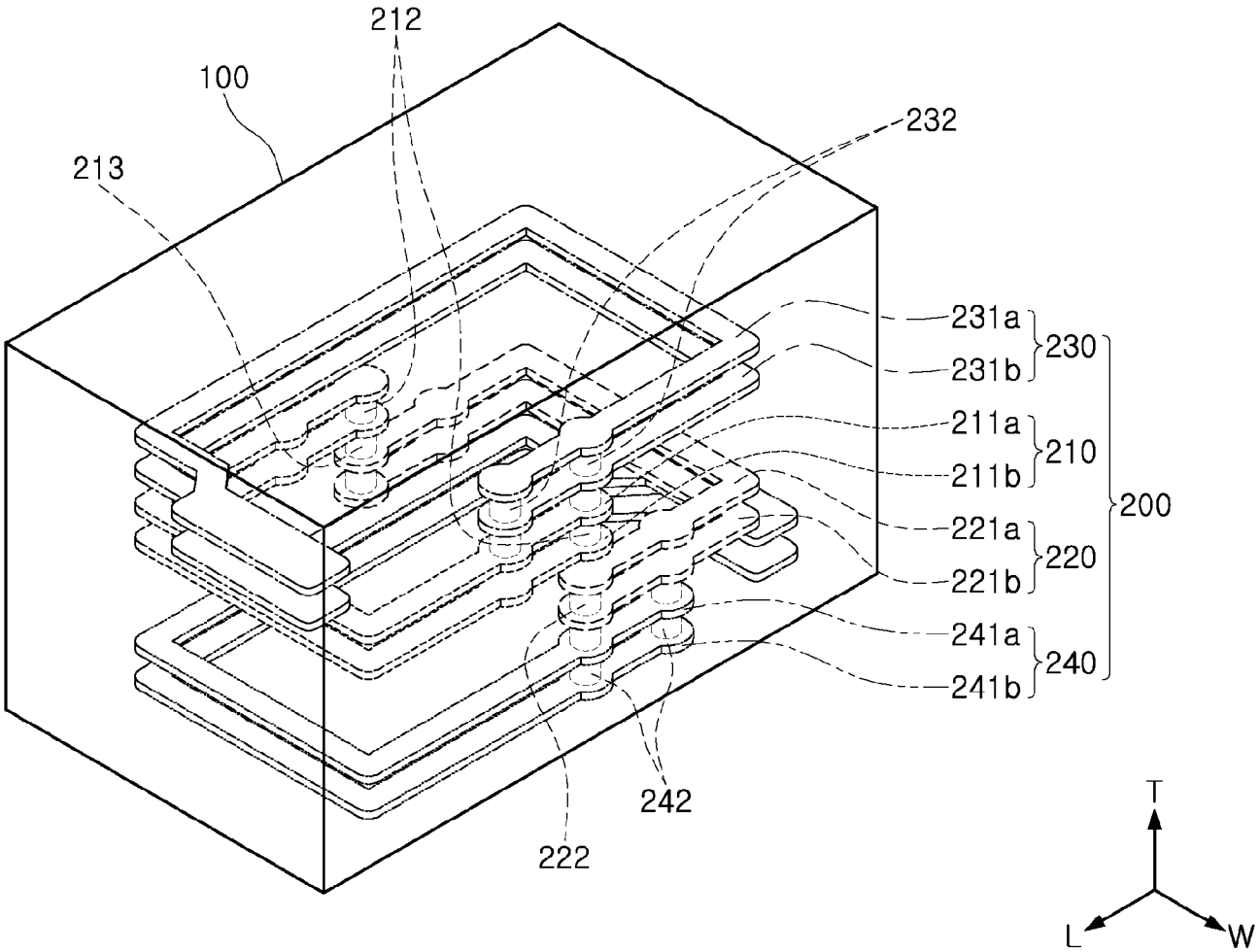
FIG. 1 is a perspective view illustrating a chip coil component having an internal coil according to an exemplary embodiment in the present disclosure.

Hereinafter, exemplary embodiments in the present disclosure will be described in detail with reference to the accompanying drawings.

The disclosure may, however, be exemplified in many different forms and should not be construed as being limited to the specific embodiments set forth herein. Rather, these embodiments are provided so that this disclosure will be thorough and complete, and will fully convey the scope of the disclosure to those skilled in the art.

In the drawings, the shapes and dimensions of elements may be exaggerated for clarity, and the same reference numerals will be used throughout to designate the same or like elements.

Hereinafter, a chip coil component according to an exemplary embodiment in the present disclosure, particularly, a multilayer inductor will be described. However, the present disclosure is not limited thereto.

FIG. 1 is a perspective view illustrating a chip coil component having an internal coil according to an exemplary embodiment in the present disclosure.

Referring to FIG. 1, the chip coil component according to an exemplary embodiment in the present disclosure may include a ceramic body 100 and an internal coil 200.

The ceramic body 100 may include first to fourth insulating layers. In this case, a plurality of insulating layers including the first to fourth insulating layers inside the ceramic body 100 are in a sintered state, and adjacent insulating layers may be integrated with each other such that boundaries therebetween may not be readily apparent without the use of a scanning electron microscope (SEM).

The ceramic body 100 may have a hexahedral shape. Directions of the hexahedral ceramic body 100 will hereinafter be defined in order to clearly describe an exemplary embodiment in the present disclosure. L, W, and T directions illustrated in FIG. 1 refer to a length direction, a width direction, and a thickness direction, respectively. In addition, the ceramic body 100 may have a bottom surface used as a mounting surface, a top surface opposing the bottom surface, both end surfaces in a length direction, and both side surfaces in a width direction.

The plurality of insulating layers may include ferrite known in the art such as Mn—Zn based ferrite, Ni—Zn based ferrite, Ni—Zn—Cu based ferrite, Mn—Mg based ferrite, Ba based ferrite, Li based ferrite, or the like.

The internal coil 200 may include a first internal pattern part 210 and a second internal pattern part 220.

The first internal pattern part 210 may include a plurality of first insulating layers on which first pattern portions 211*a* and 211*b* are disposed.

The first internal pattern part 210 may further include two first connection terminals 212 connecting the first pattern portion 211*a* positioned to be closer to the top surface of the ceramic body 100 to the first pattern portion 211*b* positioned immediately below the first pattern portion 211*a*.

The first pattern portions 211*a* and 211*b* may be disposed to correspond to each other. Here, the corresponding disposition of the first pattern portions 211*a* and 211*b* refers to the first pattern portions 211*a* and 211*b* being disposed in parallel to form a parallel structure.

More particularly, the corresponding disposition of the first pattern portions 211*a* and 211*b* may indicate that the number of turns (e.g., ½ turns, ¾ turns) and turn directions of the pattern portions are the same, while shapes thereof are identical to each other.

In this case, the two first connection terminals 212 may each have one via electrode and may be disposed in both side portions of the ceramic body 100 in the width direction thereof, respectively.

The via electrode may be formed by forming a hole in a portion of the insulating layer and filling the hole with a conductive metal, for example, silver (Ag), palladium (Pd), aluminum (Al), nickel (Ni), titanium (Ti), gold (Au), copper (Cu), platinum (Pt), or alloys thereof.

The second internal pattern part 220 may include a plurality of second insulating layers on which second patterns portions 221*a* and 221*b* are disposed.

The second internal pattern part 220 may further include two second connection terminals 222 connecting the second pattern portion 221*a* positioned to be closer to the top surface of the ceramic body 100 to the second pattern portion 221*b* positioned immediately below the second pattern portion 221*a*.

The second pattern portions 221*a* and 221*b* may be disposed to correspond to each other.

In this case, the two second connection terminals 222 may each have one via electrode and may be disposed in both side portions of the ceramic body 100 in the width direction thereof, respectively.

The first pattern portions 211*a* and 211*b* and the second pattern portions 221*a* and 221*b* may each have a '⊏'-like shape, and the first pattern portions 211*a* and 211*b* and the second pattern portions 221*a* and 221*b* may be disposed to be symmetrical to each other.

That is, as an example, the first internal pattern part 210 having the first pattern portions 211*a* and 211*b* may be disposed on one end portion of the ceramic body 100 in the length direction thereof, and the second internal pattern part 220 having the second pattern portions 221*a* and 221*b* symmetrical to the first pattern portions 211*a* and 211*b* may be disposed on the other end portion of the ceramic body 100 in the length direction In this case, the first and second internal pattern parts 210 and 220 may be connected to each other by one via electrode 213.

The internal coil 200 may further include a first lead pattern part 230 and a second lead pattern part 240. The first lead pattern part 230 may be disposed to be closer to the top surface of the ceramic body 100 than the first internal pattern part 210, by way of example, and the second lead pattern part 240 may be disposed to be closer to the bottom surface of the ceramic body 100 than the second internal pattern part 220, by way of example.

In this case, the first lead pattern part 230 and the first internal pattern part 210 may be connected to each other by one connection terminal having at least two via electrodes.

In addition, the second internal pattern part 220 and the second lead pattern part 240 may be connected to each other by one connection terminal having at least two via electrodes.

The first lead pattern part 230 may be formed by stacking a plurality of third insulating layers on which first lead pattern portions 231*a* and 231*b* are disposed. For example, the plurality of third insulating layers may have two third insulating layers being sequentially stacked, and the first lead pattern portions 231*a* and 231*b* disposed on respective third insulating layers may be disposed to correspond to each other.

In addition, the first lead pattern portions 231*a* and 231*b* may be connected to each other by one third connection terminal 232 having two via electrodes.

The second lead pattern part 240 may be formed by stacking a plurality of fourth insulating layers on which second lead pattern portions 241*a* and 241*b* are disposed. For example, the plurality of fourth insulating layers may have two fourth insulating layers being sequentially stacked, and the second lead pattern portions 241*a* and 241*b* disposed on respective fourth insulating layers may be disposed to correspond to each other.

In addition, the second lead pattern portions 241*a* and 241*b* may be connected to each other by one fourth connection terminal 242 having two via electrodes.

The internal coil 200 may be formed by printing a conductive paste containing a conductive metal. The conductive metal is not particularly limited as long as it has excellent electrical conductivity. For example, the conductive metal may be silver (Ag), palladium (Pd), aluminum (Al), nickel (Ni), titanium (Ti), gold (Au), copper (Cu), platinum (Pt), or alloys thereof.

Figure 2:
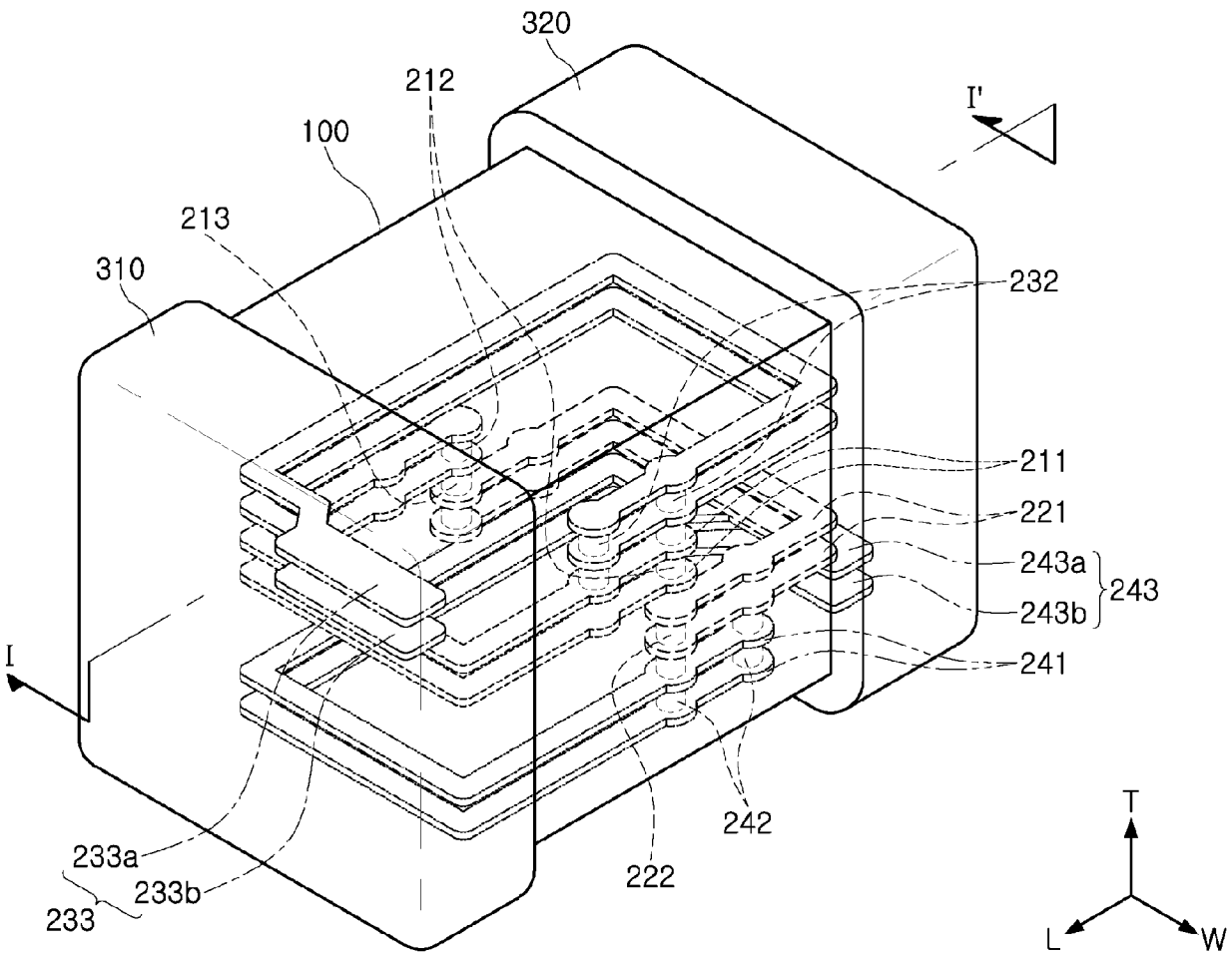
FIG. 2 is a perspective view illustrating the chip coil component of FIG. 1 having first and second external electrodes.

FIG. 2 is a perspective view illustrating the chip coil component of FIG. 1 having first and second external electrodes.

Referring to FIG. 2, the chip coil component according to this exemplary embodiment in the present disclosure may further include first and second external electrodes 310 and 320.

In addition, the first lead pattern part 230 may include a first lead portion 233 exposed to one end surface of the ceramic body 100 in the length direction thereof. The second lead pattern part 240 may include a second lead portion 243 exposed to the other end surface of the ceramic body 100 in the length direction thereof.

Figure 3:
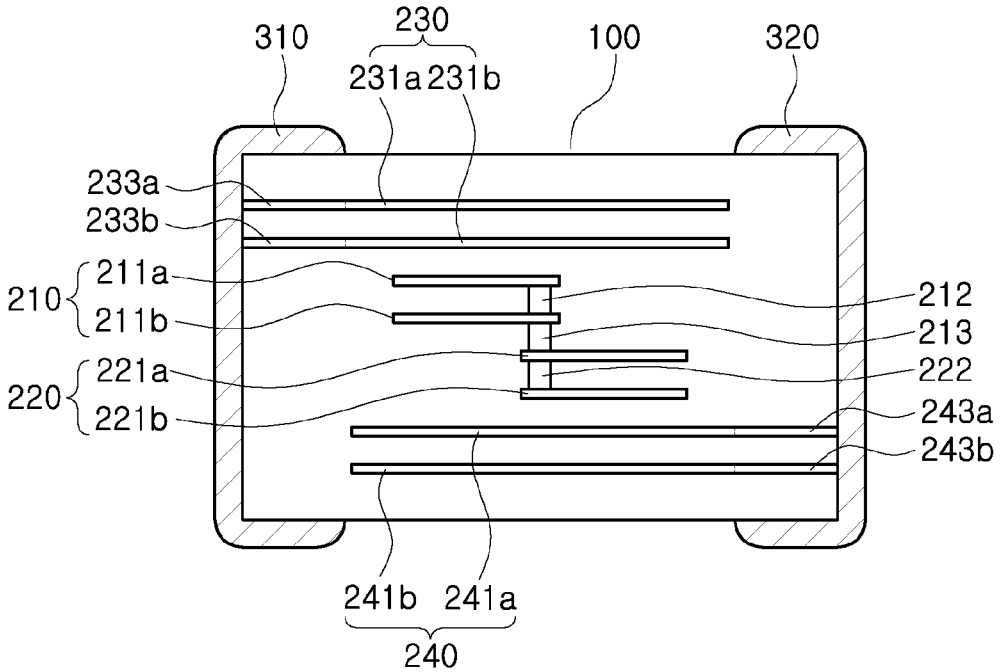
FIG. 3 is a cross-sectional view taken along line I-I' of FIG. 2.

FIG. 3 is a cross-sectional view taken along line I-I' of FIG. 2.

Being described in detail with reference to FIGS. 2 and 3, the first lead pattern portion 231*a* may include a first lead portion 233*a* and the first lead pattern portion 231*b* may include a first lead portion 233*b*.

In addition, the second lead pattern portion 241*a* may include a second lead portion 243*a* and the second lead pattern portion 241*b* may include a second lead portion 243*b*.

The first external electrode 310 may be disposed on one end surface of the ceramic body 100 in the length direction and may be electrically connected to the first lead portion 233. In addition, the second external electrode 320 may be disposed on the other end surface of the ceramic body 100 in the length direction and may be electrically connected to the second lead portion 243.

The first and second external electrodes 310 and 320 may be formed to cover respective end surfaces of the ceramic body 100 in the length direction thereof and may also be formed to be extended to the top surface, the bottom surface, and the side surfaces of the ceramic body 100 in the width direction, by way of example.

Although the first and second external electrodes 310 and 320 are formed on the end surfaces of the ceramic body 100 in the length direction and are extended to the top surface, the bottom surface, and the side surfaces of the ceramic body 100 in the width direction as illustrated in FIGS. 2 and 3, they are not limited thereto.

The first and second external electrodes 310 and 320 may be formed of a metal having excellent electrical conductivity, for example, nickel (Ni), copper (Cu), tin (Sn), silver (Ag), or alloys thereof.

Figure 4:
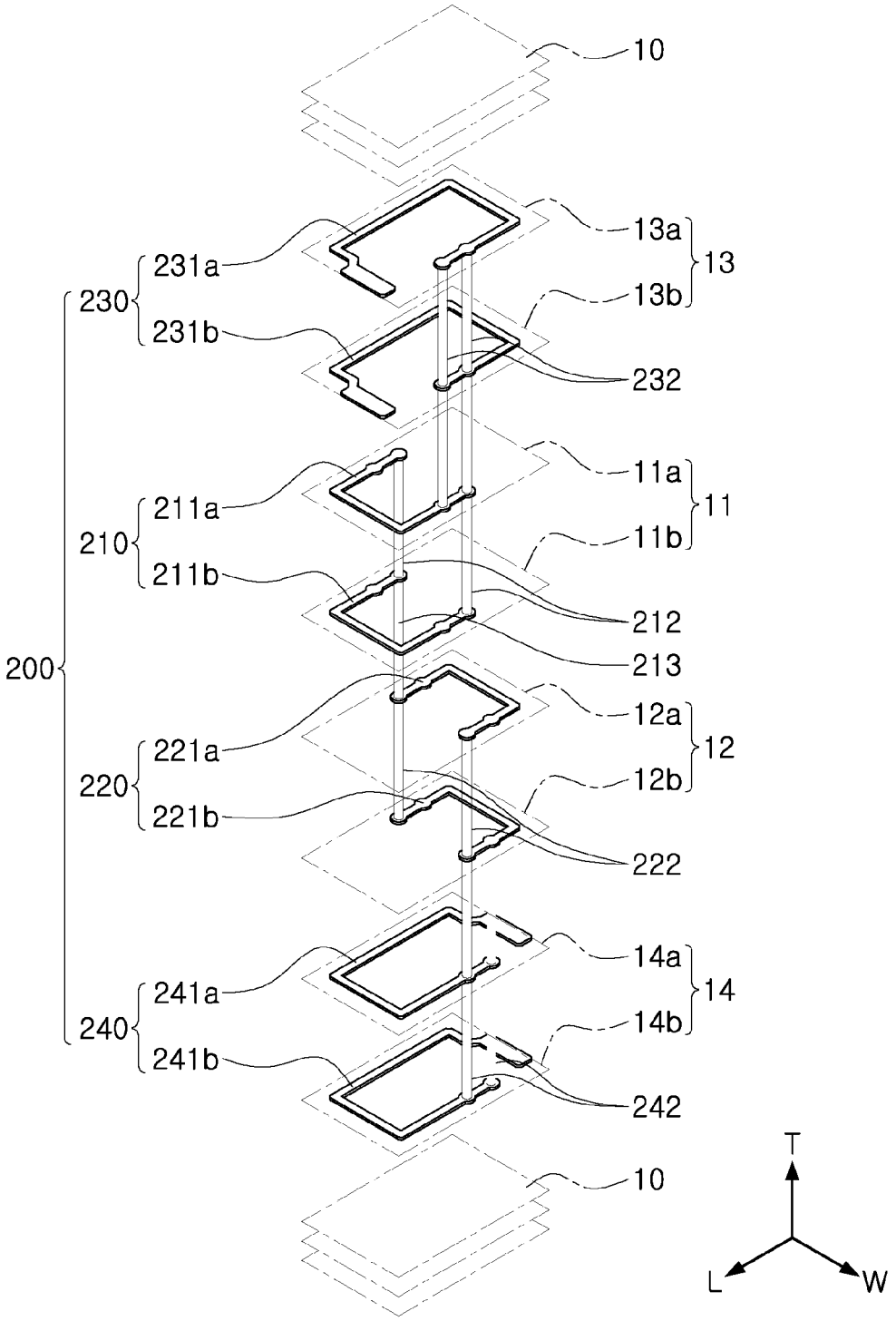
FIG. 4 is an exploded perspective view of the chip coil component according to the exemplary embodiment in the present disclosure.

FIG. 4 is an exploded perspective view of a chip coil component according to an exemplary embodiment in the present disclosure.

Referring to FIG. 4, the internal coil 200 may have a spiral coil structure formed by sequentially disposing and stacking the first lead pattern part 230, the first internal pattern part 210, the second internal pattern part 220, and the second lead pattern part 240, based on the top surface of the ceramic body 100.

The first and second lead pattern parts 230 and 240 may be connected to each other by one connection terminal 232 having a plurality of via electrodes, for example, at least two via electrodes.

In this case, since one connection terminal 232 has two or more via electrodes, even in the case in which connections between some of the via electrodes deteriorate, an open defect may be prevented as long as only one via electrode is properly connected within one connection terminal.

In the case of the first lead pattern part 230 as an example, since the first lead pattern portions 231*a* and 231*b* may be connected to each other by at least two via electrodes, direct current resistance (Rdc) may be decreased, as compared to a case in which the first lead pattern portions 231*a* and 231*b* are connected to each other by one via electrode.

It may be understood that in the chip coil component according to this exemplary embodiment in the present disclosure, the first and second internal pattern parts 210 and 220 are connected to each other by two connection terminals each having one via electrode, unlike the first and second lead pattern parts 230 and 240.

That is, the first and second internal pattern parts 210 and 220 are connected to each other by the connection terminals each having one via electrode, whereby inductance and Q factor of the chip coil component may be improved. In addition, sequential lead pattern portions in each of the first and second lead pattern parts 230 and 240 are connected to each other by at least two via electrodes, whereby Rdc characteristics of the chip coil component may be decreased.

Details thereof will be provided below with reference to FIGS. 5A through 5C.

Figure 5A:
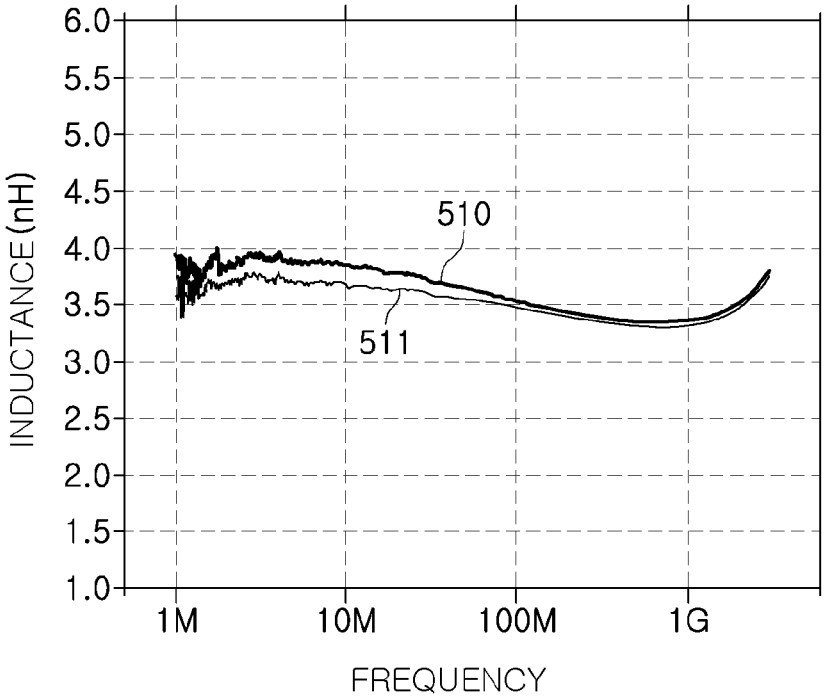
FIG. 5A is a graph illustrating results obtained by comparing inductance of the chip coil component according to the exemplary embodiment in the present disclosure with inductance of an inductor according to the related art.

FIG. 5A is a graph illustrating results obtained by comparing inductance Ls of the chip coil component according to the exemplary embodiment in the present disclosure with inductance of an inductor according to the related art.

Figure 5B:
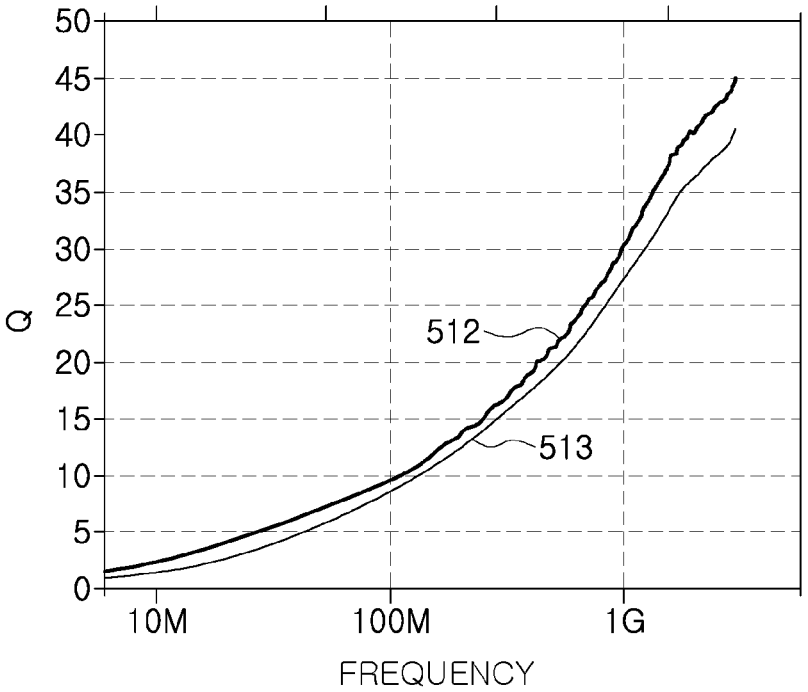
FIG. 5B is a graph illustrating results obtained by comparing Q factor of the chip coil component according to the exemplary embodiment in the present disclosure with Q factor of the inductor according to the related art.

FIG. 5B is a graph illustrating results obtained by comparing Q factor of the chip coil component according to the exemplary embodiment in the present disclosure with Q factor of the inductor according to the related art.

Figure 5C:
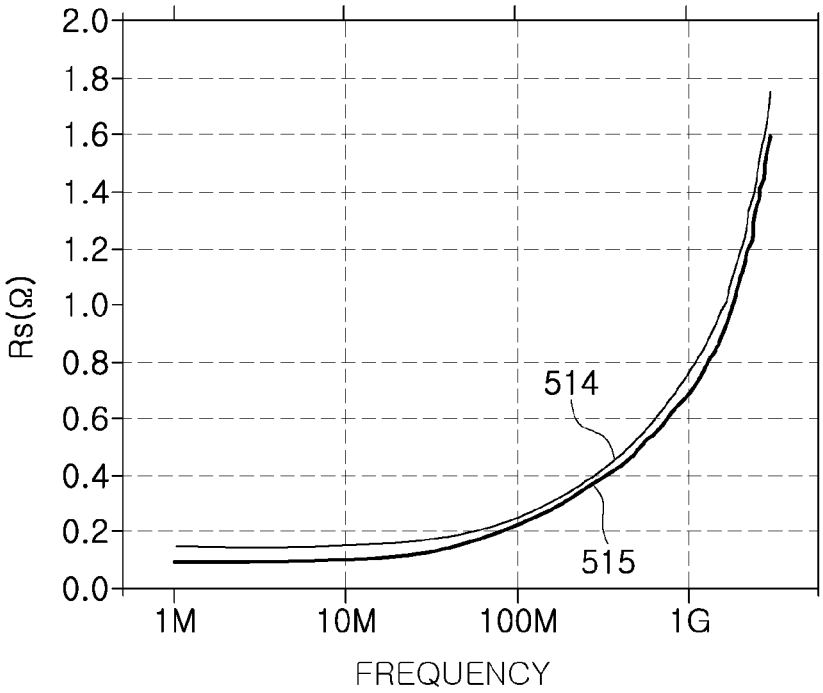
FIG. 5C is a graph illustrating results obtained by comparing resistive switching (Rs) characteristics of the chip coil component according to the exemplary embodiment in the present disclosure with Rs characteristics of the inductor according to the related art.

FIG. 5C is a graph illustrating results obtained by comparing resistive switching (Rs) characteristics of the chip coil component according to the exemplary embodiment in the present disclosure with Rs characteristics of the inductor according to the related art.

The following Table 1 represents results obtained by comparing Ls, Q factor, and Rs characteristics of the chip coil component according to the exemplary embodiment in the present disclosure with Ls, Q factor, and Rs characteristics of the inductor according to the related art.

TABLE 1

| | Ls | Q | | | | | | Rs |
|---|---|---|---|---|---|---|---|---|
| | 500 MHz | 500 MHz | 800 MHz | 1000 MHz | 1800 MHz | 2000 MHz | 2400 MHz | 1000 MHz |
| Present Disclosure | 3.35 | 21 | 27 | 30 | 39 | 40 | 42 | 0.10 |
| Related Art | 3.31 | 19 | 24 | 27 | 35 | 36 | 38 | 0.15 |

Here, the inductor according to the related art has a structure in which two coil pattern portions having the same shape are sequentially stacked and the respective coil pattern portions are connected to each other by two via electrodes.

Referring to FIG. 5A, in comparing inductance (see 510) of the chip coil component according to the exemplary embodiment in the present disclosure with inductance (see 511) of the inductor according to the related art, it can be seen that the chip coil component according to the exemplary embodiment in the present disclosure exhibits higher inductance than the inductor according to the related art.

That is, since the chip coil component according to the exemplary embodiment in the present disclosure has the first pattern portions 211*a* and 211*b* and the second pattern portions 221*a* and 221*b*, each pair of which have the same shape and are connected to each other by a single via electrode within the internal coil 200, it can be seen that the chip coil component has improved inductance characteristics as compared to the inductor according to the related art.

In addition, referring to FIG. 5B and Table 1, it can be seen that Q factor (see 512) of the chip coil component according to the exemplary embodiment in the present disclosure is superior as compared to Q factor (see 513) of the inductor according to the related art.

Further, referring to FIG. 5C and Table 1, Rs characteristics (see 514) of the chip coil component according to the exemplary embodiment in the present disclosure may be decreased as compared to Rs characteristics (see 515) of the inductor according to the related art.

Figure 6:
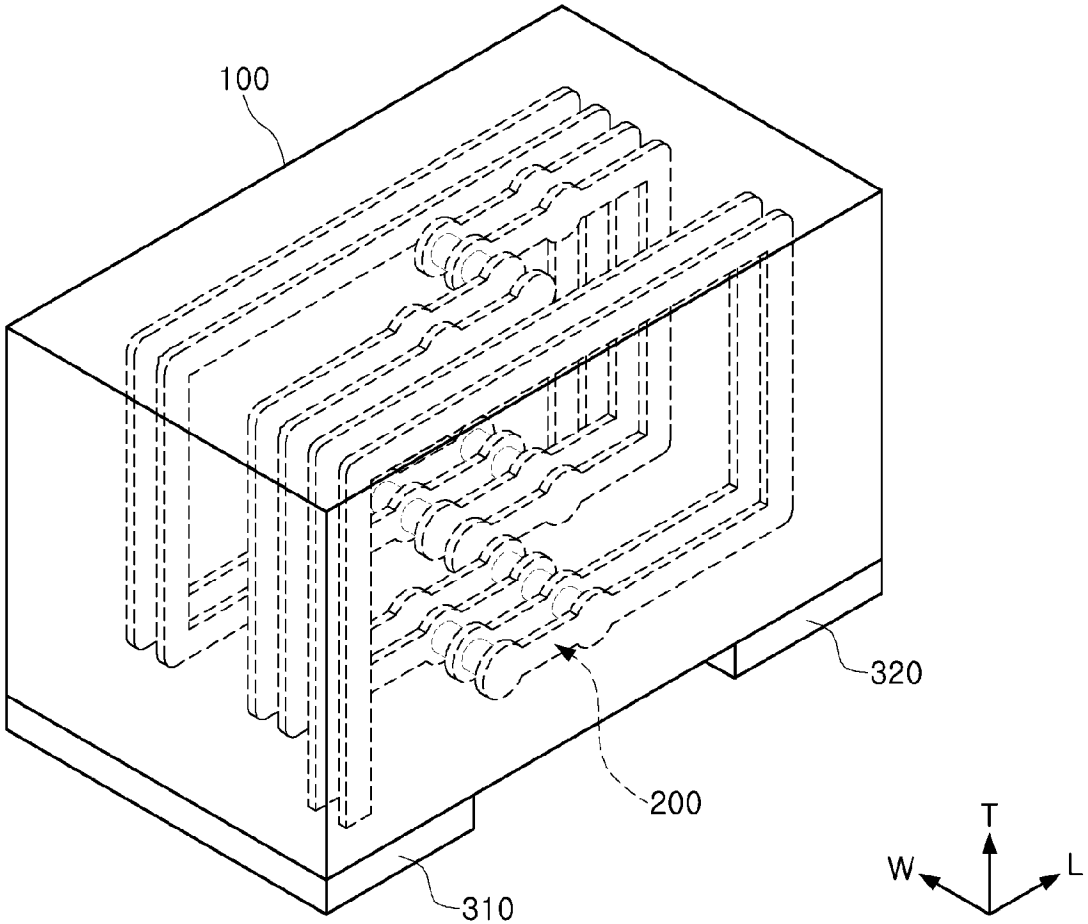
FIG. 6 is a schematic perspective view illustrating a chip coil component having an internal coil according to another exemplary embodiment in the present disclosure.

FIG. 6 is a schematic perspective view illustrating a chip coil component having an internal coil according to another exemplary embodiment in the present disclosure.

Figure 7:
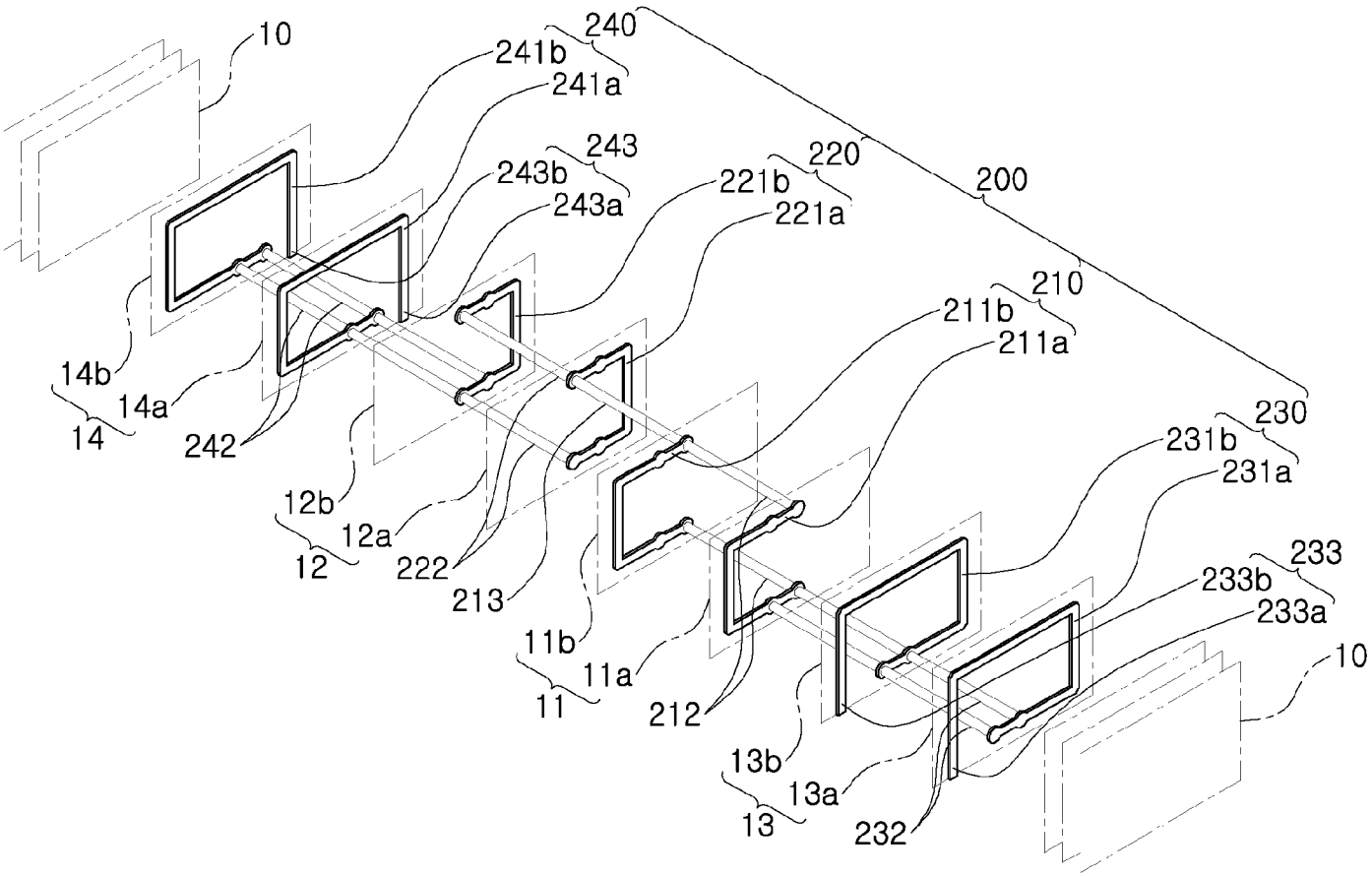
FIG. 7 is an exploded perspective view of the chip coil component according to another exemplary embodiment in the present disclosure.

FIG. 7 is an exploded perspective view of the chip coil component according to another exemplary embodiment in the present disclosure.

A description of features of the chip coil component according to this exemplary embodiment in the present disclosure the same as the features of the chip coil component according to the previous exemplary embodiment the present disclosure will be omitted.

Referring to FIGS. 6 and 7, the chip coil component according to this exemplary embodiment in the present disclosure may include a ceramic body 100 and an internal coil 200.

The internal coil 200 may be disposed to be perpendicular with respect to a bottom surface of the ceramic body 100.

That is, the internal coil 200 disposed within the ceramic body 100 may have a virtual central axis penetrating through the center of the internal coil 200 and disposed to be parallel with respect to a top surface or the bottom surface of the ceramic body 100 in a thickness direction thereof Meanwhile, the internal coil 200 may include a first internal pattern part 210 and a second internal pattern part 220.

The first internal pattern part 210 may include a plurality of first insulating layers on which first pattern portions 211*a* and 211*b* are disposed. The first internal pattern part 210 may further include two first connection terminals 212 connecting the first pattern portions 211*a* and 211*b* to each other.

The first pattern portions 211*a* and 211*b* may be disposed to correspond to each other. Here, the corresponding disposition of the first pattern portions 211*a* and 211*b* refers to the first pattern portions 211*a* and 211*b* being disposed in parallel to form a parallel structure.

More particularly, the corresponding disposition of the first pattern portions 211*a* and 211*b* may indicate that the number of turns (e.g., ½ turns, ¾ turns) and turn directions of the pattern portions are the same, while shapes thereof are identical to each other.

In this case, the two first connection terminals 212 may each have one via electrode and may be disposed in top and bottom portions of the ceramic body 100 in the thickness direction thereof, respectively.

The second internal pattern part 220 may include a plurality of second insulating layers on which second pattern portions 221*a* and 221*b* are disposed.

The second internal pattern part 220 may further include two second connection terminals 222 connecting the second pattern portions 221*a* and 221*b* to each other.

The second pattern portions 221*a* and 221*b* may be disposed to correspond to each other.

In this case, the two second connection terminals 222 may each have one via electrode and may be disposed in the top and bottom portions of the ceramic body 100 in the thickness direction thereof.

The first pattern portions 211*a* and 211*b* and the second pattern portions 221*a* and 221*b* may each have a '⊏'-like shape, and the first pattern portions 211*a* and 211*b* and the second pattern portions 221*a* and 221*b* may be disposed to be symmetrical to each other.

The internal coil 200 may include a first lead pattern part 230 and a second lead pattern part 240.

The first lead pattern part 230 may include a first lead portion 233 exposed to the bottom surface of the ceramic body 100. The second lead pattern part 240 may include a second lead portion 243 exposed to the bottom surface of the ceramic body 100.

That is, in the chip coil component according to this exemplary embodiment the present disclosure, the first and second lead portions 233 and 243 of the internal coil 200 may be stacked in a vertical manner with respect to the mounting surface so as to be exposed to the bottom surface of the ceramic body 100.

The chip coil component according to this exemplary embodiment in the present disclosure may further include first and second external electrodes 310 and 320 disposed on the bottom surface of the ceramic body 100.

The first external electrode 310 may be electrically connected to the first lead portion 233 and the second external electrode 320 may be electrically connected to the second lead portion 243.

In the chip coil component according to this exemplary embodiment in the present disclosure, the first and second internal pattern parts 210 and 220 may be connected to each other by two connection terminals each having one via electrode, unlike the first and second lead pattern parts 230 and 240.

Accordingly, the first and second internal pattern parts 210 and 220 are connected to each other by the connection terminals each having one via electrode, whereby inductance and Q factor of the chip coil component may be improved. In addition, sequential lead pattern portions in each of the first and second lead pattern parts 230 and 240 are connected to each other by at least two via electrodes, whereby Rdc characteristics of the chip coil component may be decreased.

As set forth above, according to exemplary embodiments in the present disclosure, the chip coil component may address the issue of vulnerability of the via electrode connection, thereby improving the inductance and the Q factor.

While exemplary embodiments have been shown and described above, it will be apparent to those skilled in the art that modifications and variations could be made without departing from the scope of the invention as defined by the appended claims.

What is claimed is:

1. A chip coil component, comprising:

a ceramic body including a plurality of first to fourth insulating layers; and an internal coil including a first internal pattern part having the plurality of first insulating layers on which first pattern portions are disposed, a second internal pattern part having the plurality of second insulating layers on which second pattern portions are disposed, a first lead pattern part having the plurality of third insulating layers on which first lead pattern portions are disposed, and a second lead pattern part having the plurality of fourth insulating layers on which second lead pattern portions are disposed, wherein the first pattern portions disposed on the plurality of first insulating layers are disposed to correspond to each other and are connected to each other by two first connection terminals, each having one via electrode, the second pattern portions disposed on the plurality of second insulating layers are disposed to correspond to each other and are connected to each other by two second connection terminals, each having one via electrode, the first and second internal pattern parts are connected to each other by one via electrode and disposed between the first and second lead pattern parts, the first lead pattern part and the first internal pattern part are connected to each other by at least two via electrodes, the second lead pattern part and the second internal pattern part are connected to each other by at least two via electrodes, and when viewed in a thickness direction of the chip coil component, a first distance between one end of the first internal pattern part and one end of the second internal pattern part is shorter than a second distance another end of the first internal pattern part and one end of the first lead pattern part or than a third distance between another end of the second internal pattern part and one end of the second lead pattern part.

2. The chip coil component of claim 1, wherein the two first connection terminals are disposed in side portions of the ceramic body in a width direction thereof, respectively, and the two second connection terminals are disposed in the side portions of the ceramic body in the width direction thereof, respectively.

3. The chip coil component of claim 1, wherein the first and second pattern portions have a '⊂'-like shape and the first and second pattern portions are symmetrical to each other.

4. The chip coil component of claim 1, wherein the first lead pattern pan includes a first lead portion exposed to one end surface of the ceramic body in a length direction thereof, and the second lead pattern part includes a second lead portion exposed to the other end surface of the ceramic body in the length direction thereof.

5. The chip coil component of claim 4, wherein the first lead pattern portions disposed on the plurality of third insulating layers are disposed to correspond to each other and are connected to each other by a third connection terminal having two via electrodes, and the second lead pattern portions disposed on the plurality of fourth insulating layers are disposed to correspond to each other and arm connected to each other by a fourth connection terminal having two via electrodes.

6. The chip coil component of claim 4, further comprising:

a first external electrode connected to the first lead portion; and a second external electrode connected to the second lead portion, wherein the first and second external electrodes are disposed on respective end surfaces of the ceramic body in the length direction thereof.

7. A chip coil component, comprising:

a ceramic body including a plurality of insulating layers and having a bottom surface provided as a mounting surface;

a plurality of internal pattern parts disposed within the ceramic body and having N internal coil pattern portions connected thereto, where N is multiples of 2 equal to or greater than 4;

a first lead pattern part having a plurality of first lead pattern portions, at least two of which are sequentially disposed on the insulating layers; and a second lead pattern part having a plurality of second lead pattern portions at least two of which are sequentially disposed on the insulating layers, wherein an n-th internal coil pattern portion and an n−1-th internal coil pattern portion based on an internal coil pattern portion closest to the bottom surface of the ceramic body among the N internal coil pattern portions, are connected in parallel to each other, where $n<=N$, $n=2a$, and a is a natural number, the plurality of internal coil pattern portions are connected to each other by two connection terminals, each having one via electrode, the plurality of internal pattern parts are disposed between the first and second lead pattern parts and connected to the first and second lead pattern parts by at least two via electrodes, and when viewed in a thickness direction of the chino coil component, a first distance between one end of one of the plurality of internal pattern parts and one end of another one of the plurality of internal pattern parts is shorter than a second distance between another end of the one of the plurality of internal pattern parts and one end of the first lead pattern part or a third distance between another end of the another one of the plurality of internal pattern parts and one end of the second lead pattern part.

8. The chip coil component of claim 7, wherein the n-th internal coil pattern portion and the n−1-th internal coil pattern portion are disposed on one end portion of the ceramic body in a length direction thereof when a is an odd number, and are disposed on the other end portion of the ceramic body in the length direction thereof when a is an even number, and the internal coil pattern portions when a is the even number are symmetrical to the internal coil pattern portions when a is the odd number.

9. The chip coil component of claim 7, wherein the N internal coil pattern portions have a '⊂'-like shape.

10. The chip coil component of claim 7, wherein the plurality of first lead pattern portions are connected to each other by one connection terminal having two via electrodes, and the plurality of second lead pattern portions are connected to each other by one connection terminal having two via electrodes.

11. The chip coil component of claim 7, wherein the first and second lead pattern portions include respective lead portions exposed outwardly of the ceramic body.

12. The chip coil component of claim 11, further comprising external electrodes disposed on both end surfaces of the ceramic body in a length direction thereof and connected to the lead portions.

* * * * *